United States Patent [19]

Yasumura

[11] 4,409,523

[45] Oct. 11, 1983

[54] PINCUSHION DISTORTION CORRECTION APPARATUS

[75] Inventor: Masayuki Yasumura, Yokohama, Japan

[73] Assignee: Sony Corporation, Tokyo, Japan

[21] Appl. No.: 228,677

[22] Filed: Jan. 26, 1981

[30] Foreign Application Priority Data

Jan. 31, 1980 [JP] Japan ..... 55-10700

[51] Int. Cl.[3] ..... H01J 29/70; H01J 29/56

[52] U.S. Cl. ..... 315/371; 315/400; 336/178; 336/212; 336/215

[58] Field of Search ..... 315/371, 400; 323/248, 323/250; 363/75; 336/182, 184, 178, 212, 215

[56] References Cited

U.S. PATENT DOCUMENTS

| | | | |
|---|---|---|---|
| 3,413,580 | 11/1968 | Gibas | 336/212 X |
| 3,433,998 | 3/1969 | Wölber | 315/400 X |
| 3,443,198 | 5/1969 | Wanlass | 323/250 X |
| 3,990,030 | 11/1976 | Chamberlin | 336/182 X |

*Primary Examiner*—Richard A. Farley

*Attorney, Agent, or Firm*—Hill, Van Santen, Steadman, Chiara & Simpson

[57] ABSTRACT

A pincushion distortion correction saturable reactor is a saturable transformer comprising a core having four legs, controlled and control coils being coupled to the core legs in a perpendicular relation to each other. The core gap for the controlled coil is provided in an unbalanced form, and a parabolic current at the vertical scanning frequency (or at horizontal scanning frequency) containing a superimposed DC component is supplied through the control coil to modulate the inductance of the controlled coil. The inductance of the controlled coil is thus reduced in a region where the magnetomotive force produced by the control coil is greater than that produced by the control coil to preclude deflectional distortion in the neighborhood of the center of the reproduction on the screen and improve the horizontal linearity.

6 Claims, 13 Drawing Figures

PINCUSHION DISTORTION CORRECTION APPARATUS

BACKGROUND OF THE INVENTION

1. Field of the Invention

This invention relates to pincushion distortion correction apparatus and, more particularly, to an apparatus to this end having a control coil and a controlled coil, these coils being coupled to a saturable magnetic core in a perpendicular relation to each other.

2. Description of the Prior Art

A prior-art saturable reactor apparatus for correcting pincushion distortion in a television receiver has a construction as shown in FIG. 1.

In the pincushion distortion correction transformer 21 shown in FIG. 1, saturable E and I type cores 22 and 23 are held in face to face relationship to each other with a predetermined gap $l_g$ provided between them, a control coil 27 is wound on a central leg $\mathbf{24}_A$ of the E type core 22, and first and second controlled coils $\mathbf{28}_B$ and $\mathbf{28}_C$ are wound on the respective opposite end legs $\mathbf{24}_B$ and $\mathbf{24}_C$ of the same core such that they operate differentially with respect to each other. For correcting horizontal pincushion distortions, a parabolic current changing at the vertical scanning frequency is caused through the control coil 27 to modulate the horizontal deflecting current flowing through the controlled coils $\mathbf{28}_B$ and $\mathbf{28}_C$, thus obtaining a correction such that the horizontal deflection current becomes maximum at the center of the vertical scanning portion. The inductance $L_H$ of the transformer 21 is given as $$L_H = \frac{N_{H12}}{\frac{l_g}{\mu_0 S} + \frac{l}{\mu_0 \mu_e S}} \quad (1)$$

where $N_{H1}$ and $N_{H2}$ are respectively turns numbers of the first and second controlled coils $\mathbf{28}_B$ and $\mathbf{28}_C$ ($N_{H1}=N_{H2}$), l is the average length of the magnetic path, S is the sectional area of the core, and $\mu_e$ is the effective magnetic permeability while $\mu O$ is the magnetic permeability of a vacuum.

FIG. 2 shows a pincushion distortion correction transformer disclosed in a earlier patent application filed by the same applicant, and it is mentioned here for the purpose of faccilitating the understanding of the present invention. In this transformer 31, a control coil 37 and a controlled coil 38 are wound in a perpendicular relation to each other on legs 34 and 35 of a pair of four leg cores 32 and 33. The core 32 has a square or rectangular plate-like base portion $\mathbf{34}_E$ and four legs $\mathbf{34}_A$ to $\mathbf{34}_D$ extending from the four corners of the base portion. The four legs have equal sectional area. Likewise, the core 33 has a base portion $\mathbf{35}_E$ and four legs $\mathbf{35}_A$ to $\mathbf{35}_D$. In FIG. 2, the legs $\mathbf{34}_D$ and $\mathbf{35}_D$ are concealed and not shown. The cores 32 and 33 having this construction are held such that the ends of the legs $\mathbf{34}_A$ to $\mathbf{34}_D$ of the former are respectively brought into contact with the corresponding legs $\mathbf{35}_A$ to $\mathbf{35}_D$ of the latter through predetermined gaps to define a constant space $l_g$. The control coil 37 is wound on the legs $\mathbf{34}_B$ and $\mathbf{34}_D$ of the core 32 as a set, and the controlled coil 38 is wound on the legs $\mathbf{35}_A$ and $\mathbf{35}_B$ of the core 33 as a set. The inductance of this perpendicular transformer 31 is given as $$L_H = \frac{N_{H2}}{\frac{l_g}{\mu_0 S} + \frac{l}{\mu_0 \mu_e S}} \quad (2)$$

$N_H$ in equation (2) is the turns number of the controlled coil 38 having almost half the turns of FIG. 1, and this means that for the example in FIG. 2 substantially the same variable inductance characteristic can be obtained with one half the turns number compared with the prior-art example of FIG. 1.

However, these pincushion distortion correction saturable reactor apparatus shown in FIGS. 1 and 2, have disadvantages; for example, raster shrinkage occurs in the neighborhood of the center of the screen, and the horizontal linearity is inferior.

FIG. 3 is a graph showing the variable inductance characteristic of the perpendicular transformer 31 shown in FIG. 2. In this graph, the abscissa represents the horizontal deflecting current $I_H$ (in A), and the ordinate represents the inductance $L_H$ (in $\mu$H). The vertical deflecting current $I_V$ (in mA) is taken as the parameter, and characteristic curves for 0,10,20,40 mA respectively are shown. When the inductance characteristic is as shown in FIG. 3, the reproduction on the screen has a character as shown in FIG. 4. The reproduction shown in FIG. 4 is obtained when a reference pattern consisting of a plurality of uniformly spaced vertical lines is reproduced on the television screen after the horizontal pincushion distortion correction using the transformer 31 mentioned above. The ratio of the interline space in the reproduction of FIG. 4 with respect to the interline average space in the reference pattern (in %) is as shown in FIG. 5. It will be seen that the raster shrinkage is produced in the neighborhood of the center of the screen, particularly in a horizontal deflecting current region between from −1 to +1 A. Due to this shrinkage, the horizontal linearity is inferior. Therefore the dynamic range of the variable inductance defined by the DC superimposition characteristics thereof becomes narrow.

SUMMARY OF THE INVENTION

The present invention seeks to overcome the aforementioned drawback inherent in the prior art, and its object is to provide a pincushion distortion correction saturable reactor apparatus, which is simple in construction and can improve the variable inductance characteristic and preclude the distortion of deflection in the neighborhood of the center of the reproduction, thus permitting wide improvement of the horizontal linearity and extension of the DC superimposition variable inductance dynamic range.

In accordance with an aspect of present invention, the apparatus for correcting pincushion distortion comprises a core having a gap, a control coil and a controlled coil, the control and controlled coils being wound on the core in a perpendicular relation to each other, the gap having an unbalanced configuration in the path of magnetic flux produced by the controlled coil, the control coil supplying a parabolic current for pincushion distortion correction, and the controlled coil supplying a deflecting current to be corrected.

The above and other objects, features and advantages of the illustrated embodiments of the invention will appear from the description given below, which is to be read in connection with the accompanying drawings.

BRIEF DESCRIPTION OF THE DRAWINGS

FIGS. 2 through 5 illustrate information concerning a transformer, given for the purpose of facilitating the understanding of the present invention, and of which FIG. 2 is a perspective view of the transformer;

FIG. 3 is a graph showing the variable inductance characteristic in FIG. 1 or 2;

FIG. 4 is a plan view showing the reproduction on a television screen in example FIG. 1 or 2;

FIG. 5 is a graph showing the horizontal linearity;

FIGS. 6 and 7 show a first embodiment of the present invention, and of which FIG. 6 is a perspective view showing the apparatus before the assembly, and FIG. 7 is a perspective view showing the apparatus after the assembly.

FIGS. 8 through 13 show a second embodiment of the present invention, and of which FIG. 8 is a perspective view showing the apparatus before the assembly thereof, FIG. 9 is a perspective view showing the apparatus after assembly, FIG. 10 is a fragmentary perspective view of the apparatus for illustrating the operation thereof, FIG. 11 is a graph showing the variable inductance characteristic, FIG. 12 is a plan view showing the reproduction on a television screen, and FIG. 13 is a graph showing the horizontal linearity.

DETAILED DESCRIPTION OF THE PREFERRED EMBODIMENTS

Now, a preferred embodiment of the present invention will be described in conjunction with some preferred embodiments thereof with reference to the accompanying drawings.

Figure 2:
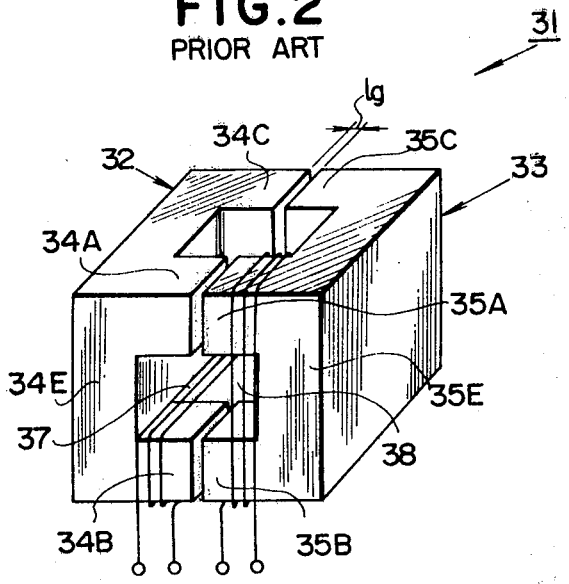
FIG.2 PRIOR ART
Figure 6:
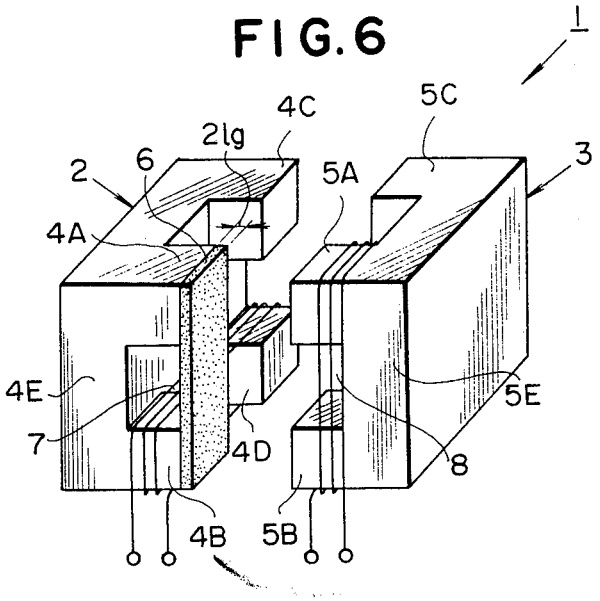
Figure 7:
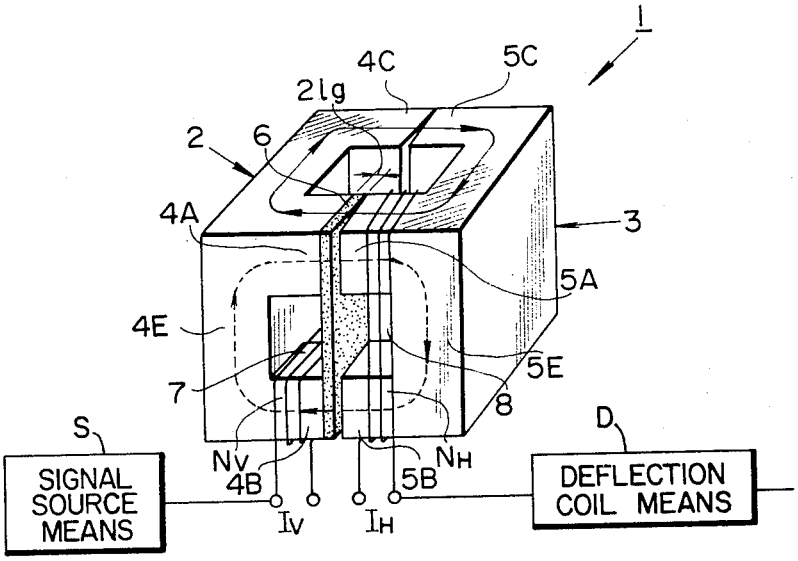

FIGS. 6 and 7 show a first embodiment of the pincushion distortion correction saturable reactor apparatus 1 according to the present invention. FIG. 6 shows a perspective view of the apparatus before the assembly thereof, and FIG. 7 shows a perspective view of the apparatus after assembly. In these Figures, the apparatus comprises cores 2 and 3 having an identical shape and made of a ferrite material. The core 2 has a plate-like base portion $4_E$, for instance having a square or rectangular shape, and four legs $4_A$,$4_B$,$4_C$ and $4_D$ perpendicularly projecting from the four corners of one side of the base portion and having an equal sectional area. Likewise, the other core 3 has a base portion $5_E$ and four leg portions $5_A$,$5_B$,$5_C$ and $5_D$. These cores 2 and 3 are arranged such that the legs $4_A$ to $4_D$ of the former abut on the corresponding legs $5_A$ to $5_D$ of the latter. More particularly, an adjacent two of the four legs of the core 2, for instance legs $4_A$ and $4_B$ are coupled to the corresponding legs of the other core, for instance legs $5_A$ and $5_B$ via a spacer 6. Thus, the faces of the legs facing each other are inclined with respect to each other, and the gap is increased toward the reader. The thickness of the spacer 6 is set substantially to 2 $l_g$, i.e., double the gap interval $l_g$ in the afore-mentioned prior-art construction. A control coil 7 is wound on a pair of legs, namely the leg $4_B$ of the core 2 in contact with the spacer 6 and the leg $4_D$ adjacent to the leg $4_B$ but not in contact with the spacer 6. A controlled coil 8 is wound on a pair of legs $5_A$ and $5_B$ of the other core 3 in contact with the spacer 6. Alternatively, the controlled coil 8 may be wound on pair legs $5_C$ and $5_D$ which are not in contact with the spacer 6. The magnetic flux produced by the current through the control coil 7 passes through a loop constituted by the legs $4_A$ and $5_A$ and legs $5_B$ and $4_B$. The magnetic flux produced by the current through the controlled coil 8 passes through a loop constituted by the legs $4_A$ and $5_A$ and legs $5_C$ and $4_C$. Since the facing faces of the individual pairs of legs constituting the path of magnetic flux set up by the controlled coil 8 are inclined due to the spacer 6 interposed between the legs $4_A$ and $5_A$ and also between the legs $4_B$ and $5_B$, the gap between these facing surfaces is increased toward the reader in the FIG. 7, that is, the gap formed in the path of magnetic flux set up by the controlled coil 8 has an unbalanced form. In the afore-mentioned prior-art example (shown in FIG. 2), in which the facing surfaces of the individual pair legs are parallel, the gaps in the magnetic flux paths for both the control and controlled coils are balanced in form.

Figure 8:
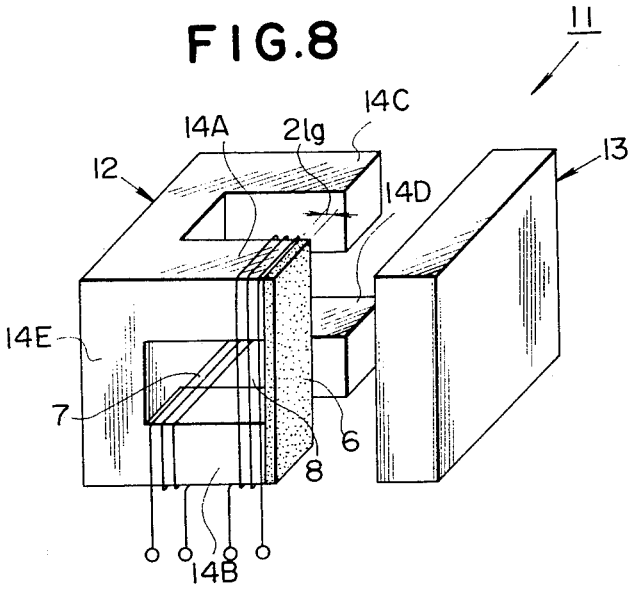
Figure 9:
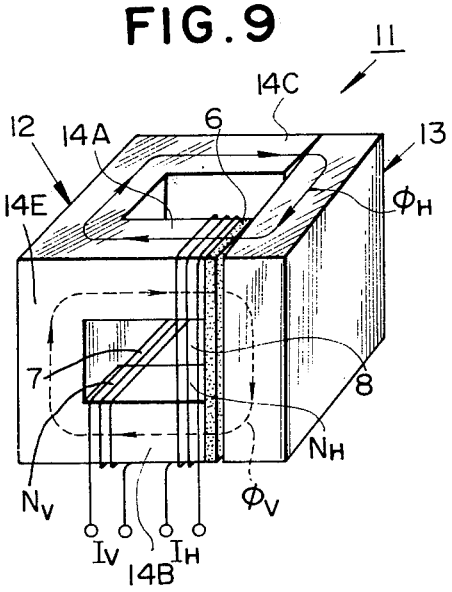
Figure 10:
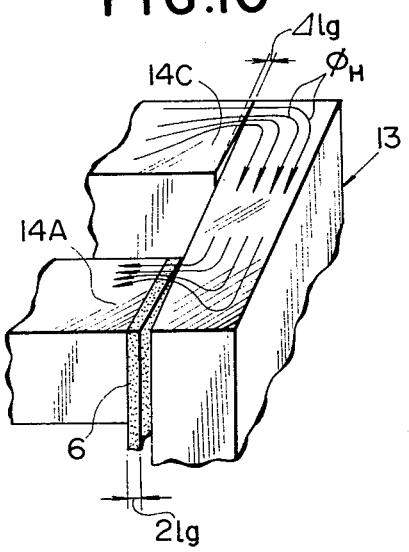

FIGS. 8 through 10 show a second embodiment of the present invention. In this embodiment of the pincushion distortion correction saturable reactor apparatus 11, a pair of cores 12 and 13 which have different shapes are used. The assembled form of the pincushion distortion saturable reactor apparatus 11 is practially the same as the apparatus of the first embodiment, but this embodiment is different from the first embodiment in the position, in which the core halves of the apparatus are coupled to each other, and the assembly can be more readily made.

More particularly, referring to FIGS. 8 and 10, the core 12 has a base portion $14_E$, for instance having a square or rectangular shape, and four legs $14_A$,$14_B$,$14_C$ and $14_D$ perpendicularly projecting from the four corners of the base portion and somewhat a greater length (capable of accommodating two coils). The core 13, on the other hand, consists of a square or rectangular plate corresponding to the base portion of cores in the first embodiment.

These cores 12 and 13 are arranged such that they abut on each other with a spacer 6 provided in contact with two adjacent legs $14_A$ and $14_B$ of the core 12 to form a gap of an unbalanced form for the controlled coil 8. The coil 7 is wound on the set of legs $14_B$ and $14_D$, and the controlled coil 8 is wound on a set of legs $14_A$ and $14_B$ in contact with the spacer 6. In this construction, the gap in the magnetic flux path for the controlled coil 8 varies for different portions of the facing surfaces and thus has an unbalanced form.

In the use of the first and second embodiments for the lateral pincushion distortion correction, parabolic current $I_V$ containing an appropriate DC bias is supplied to the control coil 7, and horizontal deflecting current $I_H$ is supplied to the controlled coil 8. In this case, the turns number $N_V$ of the control coil 7 is selected relatively large to reduce the exciting current $I_V$ so that a flux $\phi_V$ within a saturating region is produced by the magnetizing force $N_V I_V$. For the control coil 8 a large diameter wire is used, and its turns number $N_H$ is set to a value necessary for obtaining the required variable inductance for the lateral pincushion distortion correction.

The first and second embodiments having the above constructions according to the present invention operate practically in the same way, so the operation of the second embodiment only will be described.

The flux $\phi_V$ produced by the current $I_V$ through the control coil 7 passes through the leg $14_B$, base portion $14_E$ and leg $14_A$ of the core 12 and the core 13 as shown by dashed arrows in FIG. 9. Also, although not shown, a flux is caused to pass through the leg $14_D$, base portion $14_E$ and $14_C$ of the core 12 and core 13. On the other hand, the flux $\phi_H$ produced by the current $I_H$ through the controlled coil 8 passes through a loop constituted by the leg $14_A$, base portion $14_E$ and leg $14_C$ of the core 12 and the core 13 as shown by solid arrows in FIG. 9. These fluxes $\phi_V$ and $\phi_H$ do not link with each other, so that no induction voltage is produced. Thus, by causing a parabolic current at the vertical scanning frequency to flow through the control coil 7, the inductance of the controlled coil 8 can be varied to obtain the correction of the lateral pincushion distortion.

Now, the effects of the gap having the unbalanced form will be described. In a state when the magnetomotive force $N_VI_V$ provided by the control coil 7 is less than the magnetomotive force $N_HI_H$ provided by the controlled coil 8 (i.e., $N_VI_V<N_HI_H$), the flux through the four legs $14_A$ to $14_D$, and hence the magnetic permeability, is controlled by the magnetomotive force $N_HI_H$. Thus, in the neighborhood of the end faces of the legs $14_C$ and $14_D$ free from the spacer 6, the magnetic saturation in the core sets gradually in from the contact points of the legs $14_C$ and $14_D$ with the core 13, and substantially the similar variable inductance characteristic as that obtained with the balanced gap perpendicular transformer 31 shown in FIG. 2 can be obtained.

On the other hand, in a state when the magnetomotive force $N_VI_V$ is greater than the magnetomotive force $N_HI_H$ (i.e., $N_VI_H>N_HI_H$), the saturation of the core in the neighborhood of the gaps defined by the end faces of the legs $14_C$ and $14_D$ is determined by the magnetomotive force $N_VI_V$. For the flux $\phi_V$, most flux flows in one loop through the legs $14_C$ and $14_D$, because the other magnetic loop which includes the legs $14_A$ and $14_B$ has two wide gaps, therefore the magnetic reluctance of this loop is larger than that of the former. Therefore the large flux $\phi_V$ concentrates at the contact points of the legs $14_C$ and $14_D$. The concentration of flux makes the points saturate and, the saturated points act as the effective gaps. With the saturation in the neighborhood of the gaps defined by the legs $14_C$ and $14_D$, the magnetic reluctance of the gaps is apparently increased. Also, the distance of the gap in the magnetic flux path for the controlled coil 8 is increased in the gaps defined by the legs $14_C$ and $14_D$. The flux $\phi_H$ and the apparent gap $\Delta l_g$ are shown in FIG. 10.

With the apparent increase of the magnetic reluctance (i.e., increase of the gap distance), the inductance is reduced to $L_H$, which is expressed as $$L_H' = \frac{N_H 2}{\dfrac{l_g + \Delta l_g}{\mu_0 S} + \dfrac{l}{\mu_0 \mu_e S}} \tag{3}$$

where l is the average length of magnetic path, S is the sectional area of the core, and $\mu_e$ is the effective permeability, while $\mu_O$ is the permeability of a vacuum.

Figure 4:
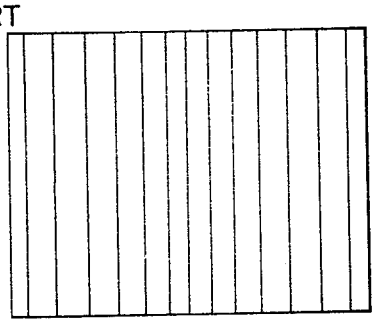
FIG.4 PRIOR ART
Figure 11:
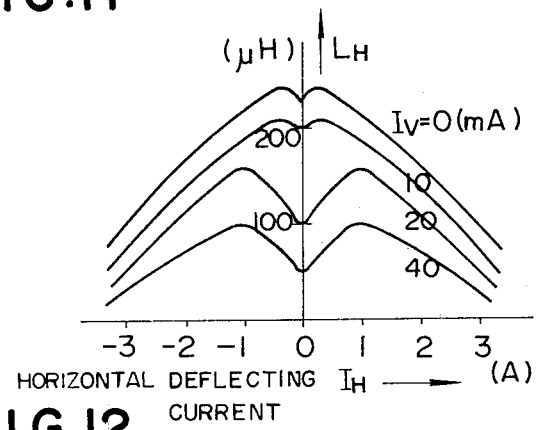
Figure 12:
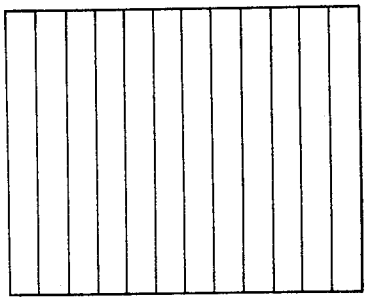
Figure 13:
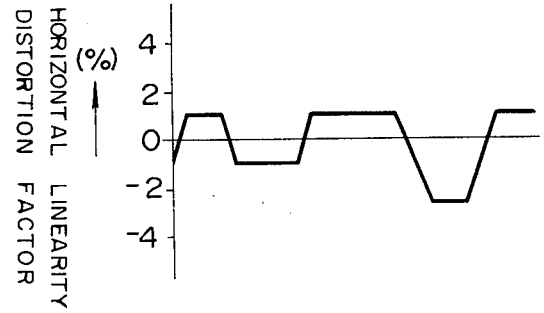

FIG. 11 shows the variable inductance characteristics of the pincushion distortion correction saturable reactor apparatus having the above construction. In the graph of FIG. 11, the ordinate is taken as the variable inductance $L_H'$ in $\mu$H, and the abscissa is taken as the horizontal deflecting current $I_H$ in A. Characteristic curves shown are obtained when the vertical parabolic current $I_V$ is respectively 0,10,20 and 40 mA. These characteristic curves have substantially M-shaped forms with the variable inductance $L_H$, reduced in an $I_H$ range in the neighborhood of 0 corresponding to the central portion of the screen. Thus, in the reproduction, the deflectional distortion in the central portion of the television screen can be widely improved as shown in FIG. 12. FIG. 12 is similar to FIG. 4, showing the reproduction of a reference pattern consisting of uniformly spaced vertical lines. In this case, extremely improved horizontal linearity compared with that shown in FIG. 5 can be obtained as shown in FIG. 13. Also, the dynamic range for the control coil current $I_V$ and controlled coil current $I_H$ can be increased. Further, with the same outer case size and current $I_H$, a larger CRT size correction is possible even with a reduced value of current $I_V$. Furthermore, with the same amplitude of control current, a larger CRT where the horizontal deflecting current is higher is possible to correct.

Figure 1:
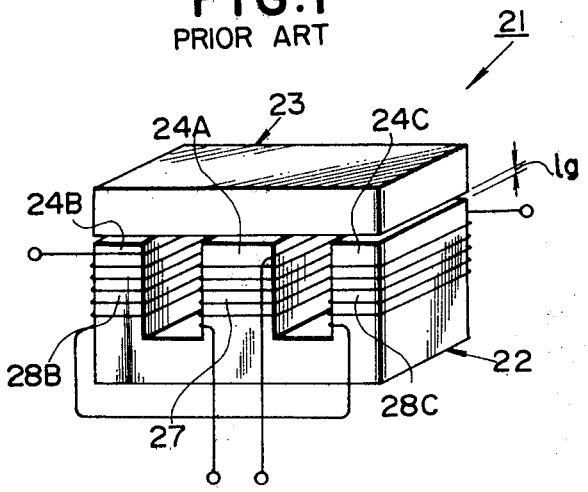
FIG.1 PRIOR ART
FIG. 1 is a perspective view showing a prior art example.
Figure 3:
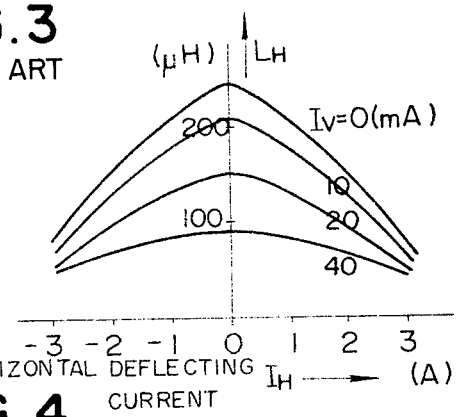
FIG.3 PRIOR ART
Figure 5:
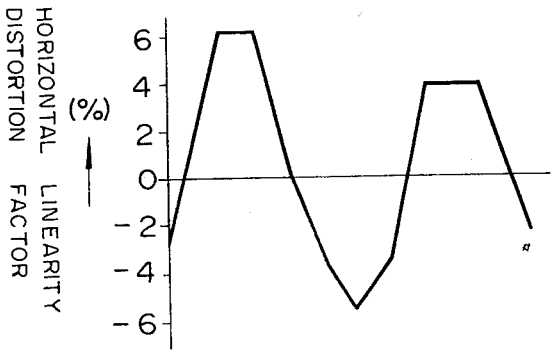
FIG.5 PRIOR ART

The characteristics of the prior-art reactor apparatus of FIG. 1, as shown in FIGS. 3 through 5, and the characteristics of the reactor apparatus according to the present invention, as shown in FIGS. 11 through 13, are based upon data obtained from experiments using a 20-inch color television receiver with a deflection angle of 100 degrees for 10% pincushion distortion correction. The relevant conditions and performance are shown in table 1.

A signal source means S is indicated in FIG. 7 for supplying a control parabolic signal to the control winding 7, and a deflection coil means D is indicated in FIG. 7 as being connected in series with the controlled winding 8, for the sake of diagrammatic illustration.

TABLE 1

| Item | Present Invention | Prior Art |
|---|---|---|
| Core Data | | |
| Gap | 75μ (unbalanced) | 38 (balanced) |
| $N_V/N_H$ (turns ratio) | $1200^T/16^T$ | $900^T/9^T + 9^T$ |
| Outer dimensions of core | 18 × 18 × 22 mm | 19 × 21.5 × 30 mm |
| Volume of core | 4608 mm³ | 9747 mm³ |
| Total weight | 38.5 g | 58.5 g |
| Performance | | |
| Horizontal linearity | +1.4%~−2.7% | +6.3%~−5.7% |
| Controlled power | 0.6 W | 0.8 W |
| Heat generation from core | 20° C. | 30° C. |

The data listed in Table 1 for the present invention are for the second embodiment. According to the present invention, the volume of the apparatus can be reduced to 0.58 times that of the prior-art apparatus. Also, the total weight can be reduced to 0.66 times that in the case of the prior art. Further, in the performance, the horizontal linearity can be improved, and the heat dissipation of the core can be reduced.

As has been described in the foregoing, with the pincushion distortion correction saturable reactor apparatus according to the present invention, which is a saturable transformer comprising a core having four legs and respective common portions (such as 4E, 5E, FIG. 7, and 13, 14E, FIG. 9), and controlled and control coils coupled to the core legs in a perpendicular relation to each other, the core gap for the controlled coil is provided in an unbalanced form, and a parabolic current at the vertical scanning frequency (or at horizontal scanning frequency) containing a superimposed DC component is caused, through the control coil, thus modulating the inductance of the controlled coil.

By the unbalance of the gap is meant that the gap distance varies with different portions of the facing surfaces defining the gap. This can be obtained by interposing a spacer between two of the four legs on which the controlled coil is wound as mentioned above or between the other two legs so that the surfaces forming the gap are inclined with respect to each other.

With this construction, the variable inductance is reduced in a region in which the magnetomotive force produced by the control coil is greater than that produced by the controlled coil and, as a whole, characteristic curves having M-shaped forms can be obtained. Thus, the deflectional distortion in the neighborhood of the center of the reproduction on the screen is reduced, so that horizontal linearity can be widely improved. In addition, the dynamic range of the variable inductance inclusive of the superimposed DC portion is extended, so that it is possible to obtain size reduction and wide cost reduction compared with the prior art. Further, it is possible to realize the reduction of heat dissipation of the core, reduction of the controlled power, reduction of the number of component parts connected to the transformer and also reduction of the area of the printed circuit board occupied by the transformer.

The above embodiments of the present invention are by no means limitative, and the invention may be applied to the top and bottom pincushion distortion correction as well. Also, various other changes and modifications are possible without departing from the scope and spirit of the present invention.

I claim:

1. A pincushion distortion correction apparatus for television receivers comprising;

a saturable transformer including a ferromagnetic core forming a cubic magnetic loop path structure, said ferromagnetic core consisting of two ferromagnetic core pieces having four legs and two common portions, a controlled winding wound on the first and second ones of said four legs of the core, a control winding wound on the second and third ones of said four legs of the core, and a space gap means provided between said two ferromagnetic core pieces;

a deflection coil being connected in series with said controlled winding; and a signal source for supplying a control parabolic signal to said control winding.

2. A pincushion distortion correction apparatus according to claim 1, wherein said two pieces constituting ferromagnetic core have respectively four legs and a common portion, and said space gap means is provided between the first and second legs of said two pieces of cores.

3. A pincushion distortion correction apparatus according to claim 1, wherein one piece of said ferromagnetic core has four legs and a common portion and the other core is a ferromagnetic core plate, and also wherein said space gap means is provided between the top of the first and second legs of said one core and said core plate.

4. A pincushion distortion correction apparatus for television receivers comprising;

a saturable transformer including a ferromagnetic core forming a cubic magnetic loop structure, said ferromagnetic core consisting of two core pieces and, said cubic magnetic loop having four magnetic legs and two common portions, a horizontal winding wound on the first and second legs of the core, a vertical winding wound on the second and third legs of the core, and a space gap means provided between said first and second legs of one of the ferromagnetic core pieces and the other core piece;

a horizontal deflection coil connected in series with said horizontal winding; and a signal source for supplying a vertical parabolic signal to said vertical winding.

5. A pincushion distortion correction apparatus according to claim 4, wherein said two pieces constituting the ferromagnetic core each have four legs and a common portion, and also wherein said space gap means is provided between the first and second one of the four legs of one of the core pieces on one hand and the corresponding legs of the other core piece on the other hand, and third and fourth legs of the two cores are in direct contact.

6. A pincushion distortion correction apparatus according to claim 4, wherein one of said core pieces of the ferromagnetic core has four legs and a common portion and the other core piece is a plate, and also wherein said space gap means is provided between the first and second ones of said four legs of said one of core pieces on one hand and said plate core piece on the other hand.

* * * * *